United States Patent [19]

Misaizu et al.

[11] Patent Number: 5,068,295

[45] Date of Patent: Nov. 26, 1991

[54] WATER AND OIL REPELLANTS

[75] Inventors: Iwao Misaizu, Urawa; Kazuyuki Hanada, Washinomiya; Akihiko Shibuya, Tokyo; Katsumi Kuriyama, Koshigaya, all of Japan

[73] Assignees: Dainichiseika Color & Chemicals Mfg. Co., Ltd.; Ukima Colour & Chemicals Mfg. Co., Ltd., both of Tokyo, Japan

[21] Appl. No.: 477,485

[22] Filed: Feb. 9, 1990

[30] Foreign Application Priority Data

Feb. 15, 1989 [JP] Japan ..... 1-33748
Feb. 15, 1989 [JP] Japan ..... 1-33749

[51] Int. Cl.[5] ..... C08F 18/20
[52] U.S. Cl. ..... 526/245
[58] Field of Search ..... 526/245

[56] References Cited

U.S. PATENT DOCUMENTS 4,673,621 6/1987 Fujiki et al. .

FOREIGN PATENT DOCUMENTS

| | | | |
|---|---|---|---|
| 0331056 | 9/1989 | European Pat. Off. | 526/245 |
| 2151035 | 2/1973 | Fed. Rep. of Germany | 526/245 |
| 3609459 | 10/1986 | Fed. Rep. of Germany | 526/245 |
| 62-116613 | 5/1987 | Japan . | |
| 63-105015 | 5/1988 | Japan | 526/245 |
| 8802498 | 4/1988 | PCT Int'l Appl. . | |

*Primary Examiner*—Joseph L. Schofer
*Assistant Examiner*—N. Sarofim
*Attorney, Agent, or Firm*—Oblon, Spivak, McClelland, Maier & Neustadt

[57] ABSTRACT

A water and oil repellant contains a copolymer of a first vinyl monomer having a perfluoroalkyl group, a second vinyl monomer having a polyorganosiloxane chain and a third vinyl monomer having an isocyanate group or blocked isocyanate group as essential components. As an alternative, a water and oil repellant contains a copolymer of a first vinyl monomer having a polyorganosiloxane chain and a second vinyl monomer having an isocyanate group or blocked isocyanate group, in combination with a water and oil repellant compound having a perfluoroalkyl group.

11 Claims, No Drawings

WATER AND OIL REPELLANTS

BACKGROUND OF THE INVENTION (1) Field of the Invention

The present invention relates to novel water and oil repellants which can impart soft feeling to textile products and the like and can show excellent water and oil repellency even after washing or dry cleaning.

(2) Description of the Related Art

Water and oil repellants comprising a comopolymer of a (meth)acrylate, which contains a perfluoroalkyl group, or a copolymer of the (meth)acrylate and another polymerizable compound such as an alkyl (meth-)acrylate, vinyl chloride, butadiene, maleic anhydride, styrene or methyl vinyl ketone have been known and widely employed for many years. The term "(meth)acrylate" as used herein should be interpreted as including both an acrylate and a methacrylate.

Treatment of a textile product with a water and oil repellant which comprises a polymer composed principally of such a perfluoroalkyl-containing (meth)acrylate however results in hard feeling. This is certainly a serious drawback, especially, when applied to dresses and the like.

In addition, a water and oil repellant which comprises a polymer composed principally of such a perfluoroalkyl-containing (meth)acrylate is accompanied by another drawback that textile products treated with the repellant show excellent water and oil repellency in the beginning but the water and oil repellency is considerably reduced after washing or dry cleaning.

With a view toward improving the durability against washing and dry cleaning, it has also been proposed to copolymerize one or more of various crosslinking monomers or to mix a melamine compound, a blocked isocyanate compound or the like with a treatment solution and then to apply water and oil repellant treatment. The methods whose effectiveness has been recognized all result in very hard feeling, so that they can be used only for extremely limited applications. Therefore, these methods have poor utility.

To soften the feeling, a silicone-type softener may be used in some instances along with a water and oil repellant, which comprises a perfluoroalkyl-containing polymer, so as to improve the feeling. However, it has generally been known that where softening effects are observed from the combined use of a silicone-type softener, the silicone-type softener gives deleterious effects to the water and oil repellency of a water and oil repellant which comprises a perfluoroalkyl-containing polymer.

SUMMARY OF THE INVENTION

An object of the present invention is therefore to provide a water and oil repellant, which unlike the conventional art can impart soft feeling and can also exhibit highly durable water and oil repellant properties even after washing or dry cleaning.

In a first aspect of the present invention, there is thus provided a water and oil repellant which comprises a copolymer of a first vinyl monomer having a perfluoroalkyl group, a second vinyl monomer having a polyorganosiloxane chain and a third vinyl monomer having an isocyanate group or blocked isocyanate group as essential components.

In a second aspect of the present invention, there is also provided a water and oil repellant which comprises in combination (a) a copolymer of a first vinyl monomer having a polyorganosiloxane chain and a second vinyl monomer having an isocyanate group or blocked isocyanate group and (b) a water and oil repellant compound having a perfluoroalkyl group.

Owing to the use of the copolymer as an essential ingredient in the water and oil repellant according to the first aspect of the present invention and because of the combined inclusion of the copolymer (a) and the water and oil repellant compound (b) as essential ingredients in the water and oil repellant according to the second aspect of the present invention, the present invention has furnished water and oil repellants which unlike the conventional art can impart soft feeling and can also exhibit highly durable water and oil repellant properties even after washing or dry cleaning.

DESCRIPTION OF THE INVENTION AND PREFERRED EMBODIMENTS

The present invention will hereinafter be described in further detail by the following preferred embodiments.

The perfluoroalkyl-containing vinyl monomer in the first aspect of the present invention may be any known perfluoroalkyl-containing vinyl monomer which has been employed in water and oil repellants. Preferred examples may include (meth)acrylates having a $C_4$–$C_{20}$ perfluoroalkyl group, such as:

$$C_8F_{17}C_2H_4OCOCH{=}CH_2;$$
$$C_6F_{13}C_2H_4OCOC(CH_3){=}CH_2;$$

$$\begin{array}{l} CF_3 \\ | \\ CFC_{10}F_{20}C_2H_4OCOCH{=}CH_2; \\ | \\ CF_3 \end{array}$$

$$C_8F_{17}C_2H_4OCOC(CH_3){=}CH_2;$$
$$C_{10}F_{21}C_2H_4OCOCH{=}CH_2;$$
$$C_8F_{17}SO_2N(C_2H_5)C_2H_4OCOCH{=}CH_2; \text{ and}$$
$$C_8F_{17}SO_2N(C_2H_5)C_2H_4OCOC(CH_3){=}CH_2.$$

On the other hand, suitable specific examples of the vinyl monomer containing a polyorganosiloxane chain may include (meth)acrylates with a polyorganosiloxane chain whose molecular weight ranges from 100 to 100,000, such as:

$$\begin{array}{l} \quad\;\; Me \quad\;\; Me \qquad\qquad\qquad Me \\ \quad\;\; | \qquad\;\; | \qquad\qquad\qquad\;\; | \\ Me{-}(SiO)_n{-}Si{-}(CH_2)_3O{-}COC{=}CH_2; \\ \quad\;\; | \qquad\;\; | \\ \quad\;\; Me \quad\;\; Me \end{array}$$

$$\begin{array}{l} \quad\;\; Me \quad\;\; Me \\ \quad\;\; | \qquad\;\; | \\ Me{-}(SiO)_n{-}Si{-}C_3H_6OC_2H_4O{-}COCH{=}CH_2; \\ \quad\;\; | \qquad\;\; | \\ \quad\;\; Me \quad\;\; Me \end{array}$$

-continued

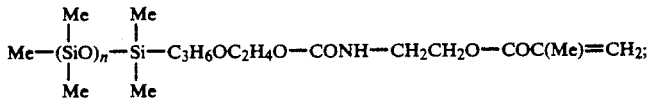

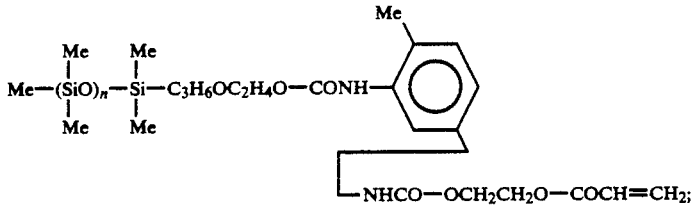

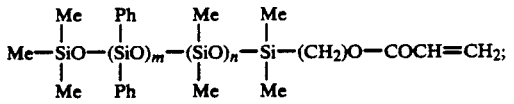

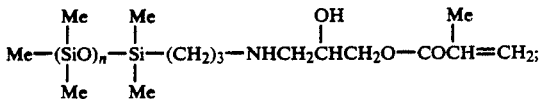

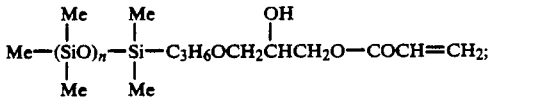

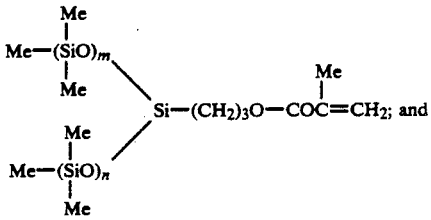

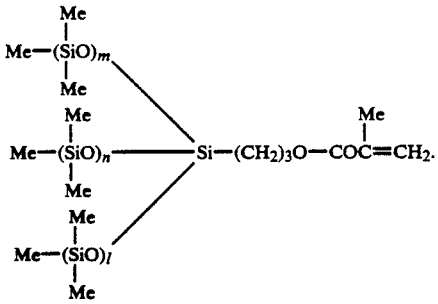

wherein Me and Ph represent a methyl group and a phenyl group, respectively, and n, m and l individually stand for a number of 1–400.

In addition, specific examples of the vinyl monomer containing an isocyanate group may include:

$H_2{=}C(CH_3)CO{-}NCO$
(methacryl isocyanate);

$H_2C{=}C(CH_3)CO{-}O{-}CH_2CH_2NCO$
(2-isocyanatoethyl methacrylate); and

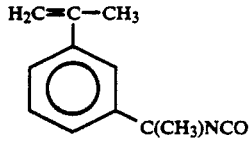

(m-isopropenyl-α,α-dimethylbenzyl isocyanate);

as well as compounds obtained by reacting active hydrogen-containing (meth)acrylates such as:
2-hydroxyethyl (meth)acrylates;
2-hydroxypropyl (meth)acrylates;
glycerol mono(meth)acrylates;
1,6-hexanediol mono(meth)acrylates;
neopentyl glycol mono(meth)acrylates;
trimethylolpropane mono(meth)acrylates;
pentaerythritol mono(meth)acrylates;
diethyleneglycol mono(meth)acrylates;
polyethyleneglycol mono(meth)acrylates;
polypropyleneglycol mono(meth)acrylates;
t-butylaminoethyl (meth)acrylates; and
polyethyleneglycol polypropyleneglycol (meth)acrylates
with organic isocyanates to form terminal isocyanate groups.

Exemplary organopolyisocyantes include:
4,4'-diphenylmethanediisocyanate;

4,4'-dicyclohexylmethanediisocyanate;
isophoronediisocyanate;
xylylenediisocyanate;
tolylenediisocyanate;
phenylenediisocyanate;
hexamethyleneisocyanate;
1,5-naphthylenediisocyanate;
"Colonate L" (trade name; product of Nippon Polyurethane Industry Co., Ltd.);
"Colonate HL" (trade name; product of Nippon Polyurethane Industry Co., Ltd.);
"Colonate EH" (trade name; product of Nippon Polyurethane Industry Co., Ltd.);
"Duranate 24A-100" (trade name; product of Asahi Chemical Industry Co., Ltd.); and
"Takenate 110N" (trade name; product of Takeda Chemical Industries, Ltd.).

On the other hand, the vinyl monomer having a blocked isocyanate group can be obtained by adding a blocking agent to a vinyl monomer which contains an isocyanate group. Illustrative of the blocking agent may include dimethyl malonate, diethyl malonate, acetylacetone, methyl acetoacetate, ethyl acetoacetate, isopropanol, t-butanol, formaldoxime, acetoaldoxime, methyl ethyl ketoxime, cyclohexanoxime, acetophenonoxime, acetoxime, benzophenonoxime, diethylglyoxime, ε-caprolactam, δ-valerolactam, γ-butyllactam, phenol, o-methylphenol, p-nitrophenol, p-naphthol, p-ethylphenol, cresol, xylenol, N-methylacetamide, acetamide, acrylamide, phthalimide, imidazole, maleimide, sodium bisulfate, potassium bisulfate, etc. Preferred examples are oxime, lactam and phenol compounds having a dissociation temperature in a range of from 50° to 180° C.

The vinyl monomer containing a blocked isocyanate group can also be prepared by adding a blocking agent to an organopolyisocyante and then adding the resultant product to an active-hydrogen-containing vinyl monomer.

Other copolymerizable vinyl monomers can also be used in the present invention.

For example, in addition to the active-hydrogen-containing (meth)acrylates described above, the following vinyl monomers may be mentioned: ethylene, vinyl acetate, vinyl chloride, styrene, vinylidene halide, acrylonitrile, o-methylstyrene, p-methylstyrene, (meth)acrylic acids and alkyl esters thereof, (meth)acrylamides, N-methylol(meth)acrylamides, vinyl alkyl ethers, vinyl alkyl ketones, butadiene, isoprene, chloroprene, maleic anhydride, itaconic acid, glycidyl (meth)acrylates, dimethylaminoethyl (meth)acrylates, diethylaminoethyl (meth)acrylates, and dimethylaminopropyl (meth)acrylates.

A conventionally-known process can be used to obtain the copolymer which is employed in the water and oil repellant according to the first aspect of the present invention. Namely, various polymerization processes such as bulk polymerization, solution polymerization, suspension polymerization, emulsion polymerization, radiation polymerization and photopolymerization can each be used. It is however preferred to obtain the copolymer by conducting solution polymerization or emulsion polymerization in the presence of a polymerization initiator. In the case of emulsion polymerization, it is necessary to use each isocyanate in the form of a blocked isocyanate.

As a solvent, any solvent can be used such as a ketone, ester, ether, alcohol, aliphatic hydrocarbon, aromatic hydrocarbon, halogenated solvent or the like.

Examples of the polymerization initiator may include various azo compounds and peroxides.

The copolymer employed in the water and oil repellant according to the present invention can be obtained by copolymerizing 5–200 parts by weight, preferably 20–100 parts by weight of a vinyl monomer containing a polyorganosiloxane chain and 2–300 parts by weight, preferably 10–200 parts by weight of a vinyl monomer containing an isocyanate group or blocked isocyanate group with 100 parts by weight of the above-described perfluoroalkyl-containing vinyl monomer. One or more other copolymerizable vinyl compounds can also be copolymerized to extents not affecting the properties of the resulting copolymer.

As the water and oil repellant compound which contains a perfluoroalkyl group and is used in the second aspect of the present invention, conventionally-known water and oil repellant compounds can each be used with those containing one or more active hydrogen atoms being especially preferred.

Representative examples are polymers of the $C_4$–$C_{20}$ perfluoroalkyl-containing vinyl monomers described in connection with the first aspect of the present invention and copolymers of the monomers with the other monomers also described above.

In addition, perfluoroalkyl-containing urethane compounds, perfluoroalkyl-containing polyester compounds, perfluoroalkyl-containing epoxy derivative compounds and the like may be mentioned as perfluoroalkyl-containing water and oil repellant compounds.

The vinyl monomer containing a polyorganosiloxane chain, the vinyl monomer containing an isocyanate group, the vinyl monomer containing a blocked isocyanate group and the other monomers, all the said monomers forming the copolymer to be mixed with the above-described water and oil repellant compound, as well as the manner of copolymerization may be as in the first aspect of the present invention.

The copolymer employed in the second aspect of the present invention can be obtained by copolymerizing 100 parts by weight of the vinyl monomer having the polyorganosiloxane chain with 5–500 parts by weight, preferably 20–200 parts by weight of the vinyl monomer having the isocyanate group or the blocked isocyanate group. One or more copolymerizable vinyl monomers can also polymerized to extents not affecting the properties of the resulting copolymer.

The water and oil repellant according to the second aspect of the present invention can be obtained by mixing 100 parts by weight of the water and oil repellant compound containing the perfluoroalkyl group with 1–300 parts by weight, preferably 10–150 parts by weight of the above copolymer. Where the water and oil repellant compound containing the perfluoroalkyl group is of the solvent type, the copolymer to be mixed with the water and oil repellant compound is also of the solvent type. Where the water and oil repellant compound containing the perfluoroalkyl group is of the aqueous type, the copolymer to be mixed with the water and oil repellant compound is also of the aqueous type. A water and oil repellant of the solvent or aqueous type can be obtained, accordingly.

Other attistatic agents, antioxidants, ultraviolet absorbers, flame retardants, anticrease or wrinkle resistance finishes, dye stabilizers and the like can also be used in combination in the water and oil repellants according to the present invention. Upon application, they are used after dilution with an organic solvent or water as needed.

Upon treatment of fibers or textile with a water and oil repellant according to the present invention, a coating method such as dipping, spraying or gravure coating can be used. After the coating, the fibers or textile is simply dried and heat treated.

In the case of a water and oil repellant containing a copolymer obtained by copolymerizing a vinyl monomer containing a blocked isocyanate group, after predrying, curing is conducted for 30 seconds to 3 minutes at a temperature equal to or higher than the dissociation temperature of the blocked isocyanate group.

Various materials can be mentioned as materials to be treated with the water and oil repellants according to the present invention. These materials may include fibers, textile, paper, leather, fur, glass, metal, various plastic films, etc.

As the fibers and also as fibers of the textile, may be mentioned natural fibers such as cotton, linen, wool and silk; synthetic fibers such as polyester fibers, nylon fibers, vinylon fibers, acrylic fibers and polyvinyl chloride fibers; and semi-synthetic fibers such as rayon fibers and acetate fibers. The water and oil repellants according to the present invention can also be used for fiber blends thereof.

In view of the excellent softening performance and the durability of excellent water and oil repellency against washing and dry cleaning, the water and oil repellants according to the present invention are useful for clothing such as coats, working wear, sportswear, casual wear, mountain parkas and yacht parkas, interior goods such as carpets, curtains, lounge furnishings or suites, and interior finish sheets for cars, etc.

As described above, textile products treated with the conventional perfluoroalkyl-containing water and oil repellants have hard feeling and when a softener is used in combination for softening purposes, deleterious effects are given to the water and oil repellant performance.

In contrast, the water and oil repellants according to the first aspect of the present invention can each form a soft film having water and oil repellency durable against washing and dry cleaning because a perfluoroalkyl segment, a polyorganosiloxane segment and an isocyanate or blocked isocyanate segment exist on a same molecule to permit easy crosslinking and orientation.

After drying and heat treatment, polyorganosiloxane segments which have formed a crosslinked structure via isocyanate groups impart not only silky feeling but also urethane-like resilient soft feeling and perfluoroalkyl segments crosslinked via isocyanate groups and oriented exhibit water and oil repellant performance durable against washing and dry cleaning.

Assisted further by the effects of the crosslinked-structure-forming polyorganosiloxane segments that they prevent the film from being damaged by abrasion during washing or dry cleaning, the water and oil repellants according to the first aspect of the present invention can exhibit super-durable water and oil repellant performance.

Accordingly, soft feeling and durable water and oil repellant performance are both materialized. This advantageous effects of the first aspect of the present invention cannot be obtained whichever essential component is omitted.

In each of the water and oil repellants according to the second aspect of the present invention, polyorganosiloxane segments formed into a crosslinked structure as a result of the crosslinking reaction of the copolymer, which was formed from the vinyl monomer having the polyorganosiloxane chain and the vinyl monomer having the isocyanate group or blocked isocyanate group and has been mixed with the perfluoroalkyl-containing water and oil repellant compound, subsequent to drying and heat treatment, have imparted silky feeling and urethane-like resilient soft feeling, and perfluoroalkyl segments crosslinked or interpenetration crosslinked via isocyanate groups, set and oriented can exhibit water and oil repellant performance durable against washing and dry cleaning.

Assisted further by the effects of the crosslinked-structure-forming polyorganosiloxane segments that they prevent the film from being damaged by abrasion during washing or dry cleaning, the water and oil repellants according to the second aspect of the present invention can exhibit super-durable water and oil repellant performance.

Accordingly, soft feeling and durable water and oil repellant performance are both materialized. This advantageous effects of the second aspect of the present invention cannot be obtained whichever essential component is omitted.

EXAMPLES

The present invention will next be described specifically by the following examples and comparative examples, in which all designations of "part" or "parts" and "%" mean part or parts by weight and wt. % unless otherwise specifically indicated.

The water repellency and oil repellency to be shown in the examples and comparative examples were measured by the following method.

Each water repellency was expressed by a water repellency number by the spraying method of JIS L-1092 (see Table 1 below). Regarding each oil repellency, the testing solutions of AATCC-118-1966 shown below in Table 2 were each placed as several droplets (diameter: about 4 mm) at two locations on the sample cloth and the oil repellency was expressed by the greatest number among testing solutions which neither penetrated into nor were absorbed in the sample cloth 30 seconds later.

TABLE 1

| Water repellency No. | State |
|---|---|
| 100 | Free of moisture adhered to the surface. |
| 90 | Slight moisture adhered to the surface. |
| 80 | Moisture partly adhered to the surface. |
| 70 | Moisture observed on the surface. |
| 50 | Moisture observed on the whole surface. |
| 0 | Moisture observed on both front and rear surfaces. |

TABLE 2

| Water repellency No. | Testing solution | surface (dyne/cm, 25° C.) |
|---|---|---|
| 8 | n-Heptane | 20.0 |
| 7 | n-Octane | 21.0 |
| 6 | n-Decane | 23.5 |
| 5 | n-Dodecane | 25.0 |

TABLE 2-continued

| Water repellency No. | Testing solution | surface (dyne/cm, 25° C.) |
|---|---|---|
| 4 | n-Tetradecane | 26.7 |
| 3 | n-Hexadecane | 27.3 |
| 2 | 35:65 Mixture of hexadecane and nujol | 29.6 |
| 1 | Nujol | 31.2 |
| 0 | Below 1 | |

Washing was conducted following the air-drying finish of JIS-L-0217-103, while washing and dry cleaning were performed following the air-drying finish of JIS-L-1018.E-2.

EXAMPLE 1

| | Parts |
|---|---|
| $C_8F_{17}SO_2N(C_2H_5)C_2H_4OCOCH{=}CH_2$ | 100 |
| 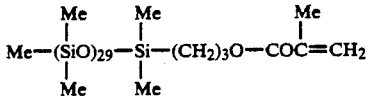 | 40 |
| 2-Isocyanatoethyl methacrylate | 40 |
| Methyl ethyl ketone | 360 |
| 1,1,1-Trichloroethane | 360 |
| Azoisobutyronitrile | 1.8 |

The above materials were charged, and a copolymerization reaction was conducted at 70° C. for 10 hours under a nitrogen gas stream to obtain a clear pale yellow solution having a solid content of 20%.

The copolymer solution was then diluted with 1,1,1-trichloroethane to give a solid content of 0.5%. Cotton broad cloths were dipped in the thus-diluted solution. After squeezed through a mangle, the cloths were dried at 80° C. for 2 minutes and then heat treated at 160° C. for 2 minutes.

The feeling of the cloths as well as their water repellency and oil repellency before and after washed 10 times or dry cleaned 10 times are shown in Table 3.

For the sake of comparison, the procedure of Example 1 was repeated as Comparative Example 1 except for the substitution of butyl methacrylate for the methacrylate having the polyorganosiloxane chain and further as Comparative Example 2 except for the replacement of 2-isocyanatoethyl methacrylate by butyl methacrylate. The results are also shown in Table 3.

TABLE 3

| | Example 1 | Comp. Ex. 1 | Comp. Ex. 2 |
|---|---|---|---|
| Feeling | 5 | 1 | 3 |
| Initial water repellency | 100 | 100 | 100 |
| Initial oil repellency | 6 | 6 | 6 |
| Water repellency after washed 10 times | 90–100 | 0–50 | 0 |
| Oil repellency after washed 10 times | 5–6 | 3 | 1 |
| Water repellency after dry cleaned 10 times | 100 | 50 | 0–50 |
| Oil repellency after dry cleaned 10 times | 5–6 | 3 | 1 |

The feeling was ranked by feeling to the touch.

Ranking system:

5 . . . Somewhat softer than the feeling of the raw cloth.

4 . . . Substantially the same feeling as the raw cloth.

3 . . . Somewhat harder than the feeling of the raw cloth.

2 . . . Apparently harder than the feeling of the raw cloth.

1 . . . Very hard compared with the feeling of the raw cloth.

EXAMPLE 2

| | Parts |
|---|---|
| $C_8F_{17}C_2H_4OCOCH{=}CH_2$ | 100 |
| 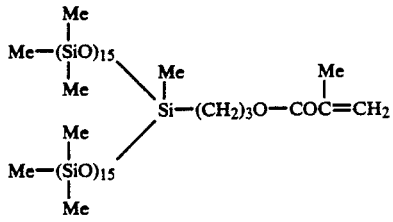 | 50 |
| 2-Isocyanatoethyl methacrylate/methyl ethyl ketoxime adduct (molar ratio: 1:1) | 50 |
| Methyl ethyl ketone | 400 |
| 1,1,1-Trichloroethane | 400 |
| Azoisobutyronitrile | 2 |

The above materials were charged and reacted in a similar manner to Example 1, thereby obtaining a clear pale yellow solution having a solid content of 20%.

The copolymer solution was then diluted with 1,1,1-trichloroethane to give a solid content of 0.5%. Nylon taffeta were dipped in the thus-diluted solution. After squeezed through a mangle, the taffeta were dried at 80° C. for 2 minutes and then heat treated at 160° C. for 2 minutes.

The feeling of the taffeta as well as their water repellency and oil repellency before and after washed 10 times or dry cleaned 10 times are shown in Table 4.

For the sake of comparison, the procedure of Example 2 was repeated as Comparative Example 3 except for the substitution of styrene for the methacrylate having the polyorganosiloxane chain and further as Comparative Example 4 except for the replacement of 2-isocyanatoethyl methacrylate/methyl ethyl ketoxime adduct by styrene. The results are also shown in Table 3.

TABLE 4

| | Example 2 | Comp. Ex. 3 | Comp. Ex. 4 |
|---|---|---|---|
| Feeling | 5 | 1 | 2 |
| Initial water repellency | 100 | 100 | 100 |
| Initial oil repellency | 6 | 6 | 6 |
| Water repellency after washed 10 times | 90–100 | 50 | 0 |
| Oil repellency after washed 10 times | 6 | 3 | 1 |
| Water repellency after dry cleaned 10 times | 100 | 50 | 0–50 |
| Oil repellency after dry cleaned 10 times | 6 | 3 | 2 |

EXAMPLE 3

| | Parts |
|---|---|
| $C_8F_{17}C_2H_4OCOC(CH_3)=CH_2$ | 100 |
| $Me-(SiO)_{19}-Si(Me)_2-(CH_2)_3O-COC(Me)=CH_2$ | 30 |
| 2-Hydroxyethyl acrylate/tolylene diisocyanate/acetoxime adduct (molar ratio: 1:1:1) | 30 |
| Acetone | 100 |
| Non-ionic emulsifier | 3 |
| Dimethyloctadecylamine acetate | 3 |
| Azoisobutylamidine dihydrochloride | 0.8 |
| Deionized water | 565 |

The above materials were charged, and a copolymerization reaction was conducted at 65° C. for 15 hours under a nitrogen gas stream to obtain a latex having a solid content of 20%. The latex was then diluted with water to give a solid content of 0.5%.

Mixed cloths of polyester/cotton (65/35) were dipped in the thus-diluted latex. After squeezed through a mangle, the cloths were dried at 110° C. for 2 minutes and then heat treated at 160° C. for 2 minutes. The feeling of the cloths as well as their water repellency and oil repellency before and after washed 10 times or dry cleaned 10 times are shown in Table 5.

EXAMPLE 4

| | Parts |
|---|---|
| $C_8F_{17}C_2H_4OCOCH=CH_2$ | 100 |
| $(Me-(SiO)_{10})_3Si-(CH_2)_3O-COC(Me)=CH_2$ | 50 |
| Methacryloyl isocyanate/acetoxime adduct (molar ratio: 1:1) | 50 |
| Acetone | 100 |
| Non-ionic emulsifier | 4 |
| Dimethyloctadecylamine acetate | 4 |
| Azoisobutylamidine dihydrochloride | 0.9 |
| Deionized water | 732 |

The above materials were charged and then reacted in a similar manner to Example 3, thereby obtaining a latex having a solid content of 20%. The latex was tested in a similar manner to Example 3. The results are shown in Table 5.

EXAMPLE 5

| | Parts |
|---|---|
| $C_8F_{17}C_2H_4OCOCH=CH_2$ | 100 |
| $Me-(SiO)_{14}-Si(Me)_2-(CH_2)_3O-COC(Me)=CH_2$ | 40 |
| 2-Hydroxypropyl acrylate/4,4-dicyclohexylmethanediisocyanate/methyl ethyl ketonoxime (molar ratio: 1:1:1) | 40 |
| Acetone | 100 |
| Non-ionic emulsifier | 3.5 |
| Octadecylamine acetate | 3.5 |
| Azoisobutylamidine dihydrochloride | 0.1 |
| Deionized water | 648 |

The above materials were charged and then reacted in a similar manner to Example 3, thereby obtaining a latex having a solid content of 20%. The latex was tested in a similar manner to Example 3. The results are shown in Table 5.

COMPARATIVE EXAMPLE 5

A commercial water and oil repellant of the fluorinated polyacrylated emulsion type (solid content: 20%) was tested in a similar manner to Example 3. The results are shown in Table 5.

TABLE 5

| | Ex. 3 | Ex. 4 | Ex. 5 | Comp. Ex. 5 |
|---|---|---|---|---|
| Feeling | 5 | 5 | 5 | 2 |
| Initial water repellency | 100 | 100 | 100 | 100 |
| Initial oil repellency | 6 | 6 | 6 | 6 |
| Water repellency after washed 10 times | 90–100 | 90–100 | 90 | 0 |
| Oil repellency after washed 10 times | 6 | 6 | 6 | 2 |
| Water repellency after dry cleaned 10 times | 100 | 100 | 90–100 | 0–50 |
| Oil repellency after dry cleaned 10 times | 6 | 6 | 6 | 2 |

EXAMPLE 6

| | Parts |
|---|---|
| $C_8F_{17}C_2H_4OCOCH=CH_2$ | 80 |
| 2-Ethylhexyl methacrylate | 18 |
| 2-Hydroxyethyl methacrylate | 2 |
| 1,1,1-Trichloroethane | 400 |
| Azoisobutyronitrile | 1 |

The above materials were charged and then subjected to a copolymerization reaction at 70° C. for 10 hours under a nitrogen gas stream, thereby obtaining a water and oil repellant compound (A) having a solid content of 20%.

On the other hand,

| | Parts |
|---|---|
| $Me-(SiO)_{29}-Si(Me)_2-(CH_2)_3O-COC(Me)=CH_2$ | 100 |
| 2-Isocyanatoethyl methacrylate | 100 |
| 1,1,1-Trichloroethane | 800 |
| Azoisobutyronitrile | 2 |

were charged and then subjected to a copolymerization reaction at 70° C. for 10 hours under a nitrogen gas stream, thereby obtaining a copolymer (I) having a solid content of 20%.

Sixty parts of the compound (A) and 40 parts of the copolymer (I) were mixed, followed by dilution with 1,1,1-trichloroethane to give a solid content of 1%. Nylon taffeta were dipped in the thus-diluted mixture. After squeezed through a mangle, they were dried at 80° C. for 2 minutes and then heat treated at 160° C. for 2 minutes.

The feeling of the taffeta and their water repellency and oil repellency after washed 10 times and dry cleaned 10 times, respectively are shown in Table 6.

EXAMPLE 7

| | Parts |
|---|---|
| 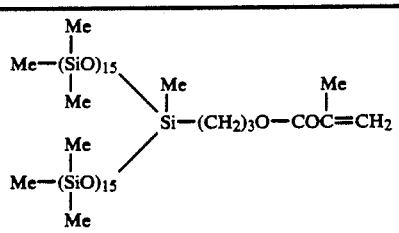 | 100 |
| 2-Isocyanatoethyl methacrylate/methyl ethyl ketoxime adduct (molar ratio: 1:1) | 150 |
| 1,1,1-Trichloroethane | 1,000 |
| Azoisobutyronitrile | 2.5 |

The above materials were charged and then subjected to a copolymerization reaction a similar manner to Example 6, thereby obtaining a copolymer (II) having a solid content of 20%.

A test was conducted in a similar manner to Example except for the replacement of the copolymer (I) by the copolymer (II). The results are shown below in Table 6.

For the sake of comparison, as Comparative Example 6, the compound (A) of Example 6 was diluted with 1,1,1-trichloroethane to a solid content of 1% and a test was then conducted in a similar manner to Example 6. The results are also shown in Table 6.

TABLE 6

| | Example 6 | Example 7 | Comp. Ex. 6 |
|---|---|---|---|
| Feeling | 5 | 5 | 2 |
| Initial water repellency | 100 | 100 | 100 |
| Initial oil repellency | 6 | .6 | 6 |
| Water repellency after washed 10 times | 90–100 | 90–100 | 0 |
| Oil repellency after washed 10 times | 5–6 | 5–6 | 2 |
| Water repellency after dry cleaned 10 times | 100 | 100 | 0–50 |
| Oil repellency after dry cleaned 10 times | 6 | 6 | 3 |

EXAMPLE 8

| | Parts |
|---|---|
| $C_8F_{17}C_2H_4OCOC(CH_3)=CH_2$ | 80 |
| 2-Ethylhexyl methacrylate | 15 |
| N-Methylolacrylamide | 5 |
| Acetone | 100 |
| Dimethyloctadecylamine acetate | 4 |
| Azoisobutylamidine dihydrochloride | 0.5 |

-continued

| | Parts |
|---|---|
| Deionized water | 316 |

The above materials were charged, and a copolymerization reaction was conducted at 65° C. for 15 hours under a nitrogen gas stream to obtain a water and oil repellant compound (B) having a solid content of 20%.

On the other hand,

| | Parts |
|---|---|
| 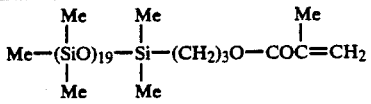 | 100 |
| 2-Hydroxyethyl acrylate/tolylene-diisocyanate/acetoxime adduct (molar ratio: 1:1:1) | 100 |
| Acetone | 100 |
| Non-ionic emulsifier | 8 |
| Azoisobutylamidine dihydrochloride | 1 |
| Deionized water | 732 |

were charged and then subjected to a copolymerization reaction in a similar manner as described above, thereby obtaining a copolymer (III) having a solid content of 20%.

Sixty parts of the compound (B) and 40 parts of the copolymer (III) were mixed, followed by dilution with water to give a solid content of 1%. Cotton broad cloths were dipped in the thus-diluted mixture. After squeezed through a mangle, they were dried at 80° C. for 2 minutes and then heat treated at 160° C. for 2 minutes.

The feeling of the cloths and their water repellency and oil repellency after washed 10 times and dry cleaned 10 times, respectively are shown in Table 7.

EXAMPLE 9

| | Parts |
|---|---|
| 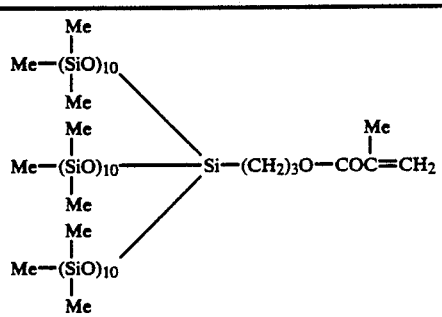 | 100 |
| Methacryloyl isocyanate/acetoxime adduct (molar ratio: 1:1) | 60 |
| Acetone | 50 |
| Non-ionic emulsifier | 6 |
| Azoisobutylamidine dihydrochloride | 1 |
| Deionized water | 614 |

The above materials were charged and then subjected to a copolymerization reaction in a similar manner to Example 8, thereby obtaining a copolymer (IV) having a solid content of 20%.

A test was conducted in a similar manner to Example 8 except for the replacement of the copolymer (III) by the copolymer (IV). The results are shown in Table 7.

EXAMPLE 10

| | Parts |
|---|---|
|  | 100 |
| 2-Hydroxypropyl acrylate/4,4'-dicyclohexylmethanediisocyanate/methyl ethyl ketone adduct (molar ratio: 1:1:1) | 80 |
| Acetone | 50 |
| Non-ionic emulsifier | 4 |
| Azoisobutylamidine dihydrochloride | 1 |
| Deionized water | 686 |

were charged and then subjected to a copolymerization reaction in a similar manner to Example 8, thereby obtaining a copolymer (V) having a solid content of 20%.

A test was conducted in a similar manner to Example 8 except for the replacement of the copolymer (III) by the copolymer (V). The results are shown in Table 7.

For the sake of comparison, as Comparative Example 7, the compound (B) of Example 8 was diluted with water to a solid content of 1% and a test was then conducted in a similar manner to Example 8. The results are also shown in Table 7.

TABLE 7

| | Ex. 8 | Ex. 9 | Ex. 10 | Comp. Ex. 7 |
|---|---|---|---|---|
| Feeling | 5 | 5 | 5 | 2 |
| Initial water repellency | 100 | 100 | 100 | 100 |
| Initial oil repellency | 6 | 6 | 6 | 6 |
| Water repellency after washed 10 times | 90–100 | 90–100 | 90–100 | 0 |
| Oil repellency after washed 10 times | 5–6 | 5–6 | 5–6 | 1 |
| Water repellency after dry cleaned 10 times | 90–100 | 100 | 90–100 | 0–50 |
| Oil repellency after dry cleaned 10 times | 5–6 | 6 | 5–6 | 1 |

We claim:

1. A water and oil repellant, comprising a copolymer of a first vinyl monomer having a perfluoroalkyl group, a second vinyl monomer having a polyorganosiloxane chain and a third vinyl monomer having an isocyanate group or a block isocyanate group as essential components, said vinyl monomer having an isocyanate group being selected from the group consisting of methacryl isocyanate, m-isopropenyl-α,α-dimethyl isocyanate and a compound formed by reacting any of 2-hydroxethyl (meth)acrylates, 2-hydroxypropyl (meth)acrylates, glycerol mono(meth)acrylates, 1,6-hexanediol mono(meth)acrylates, neopentyl glycol mono(meth)acrylates, trimethylolpropane mono(meth)acrylates, pentaerythritol mono(meth)acrylates, diethyleneglycol mono(meth)acrylates, polyethyleneglycol mono(meth)acrylates, polypropyleneglycol mono(meth)acrylates, t-butylaminoethyl (meth)acrylates and polyethyleneglycol polypropyleneglycol (meth)acrylates with any one of 4,4'-diphenylmethane diisocyante, 4,4'-dicyclohexylmethane diisocyanate, isophorone, diisocyanate, xylylene diisocyanate, tolylene diisocyanate, phenylene diisocyanate, hexamethylene diisocyanate, and 1,5-naphthylene diisocyanate; said block isocyanate group being any one of the above isocyanate groups blocked with a blocking agent.

2. A water and oil repellant, comprising in combination:

a) a copolymer of a first vinyl monomer having a polyorganosiloxane chain and a second vinyl monomer having an isocyanate group or block isocyanate group; and b) a water and oil repellant compound having a perfluoroalkyl group, and wherein said second vinyl monomer having an isocyanate group is selected from the group consisting of methacryl isocyanate, m-isopropenyl-α,α-dimethyl isocyanate and a compound formed by reacting any of 2-hydroxyethyl (meth)acrylates, 2-hydroxypropyl (meth)acrylates, glycerol mono(meth)acrylates, 1,6-hexanediol mono(meth)acrylates, neopentyl glycol mono(meth)acrylates, trimethylolpropane mono(meth)acrylates, pentaerythritol mono(meth)acrylates, diethyleneglycol mono(meth)acrylates, polyethyleneglycol mono(meth)acrylates, polypropyleneglycol mono(meth)acrylates, t-butylaminoethyl (meth)acrylates and polyethyleneglycol polypropyleneglycol (meth)acrylates with any one of 4,4'-diphenylmethane diisocyanate, 4,4'-dicyclohexylmethane diisocyanate, isophorone diisocyanate, xylylene diisocyanate, tolylene diisocyanate, phenylene diisocyanate, hexamethylene diisocyanate, and 1,5-naphthylene diisocyanate; said block isocyanate group being any one of the above isocyanate groups blocked with a blocking agent.

3. The repellant of claim 1, wherein the first vinyl monomer is a (meth)acrylate having a $C_4$–$C_{20}$ perfluoroalkyl group.

4. The repellant of claim 1, wherein the polyorganosiloxane chain of the second vinyl monomer has a molecular weight of 100–100,000.

5. The repellant of claim 1, wherein the copolymer comprises 100 parts by weight of the first vinyl monomer, 5–200 parts by weight of the first vinyl monomer, 300 parts by weight of the third vinyl monomer.

6. The repellant of claim 2, wherein the first vinyl monomer is a (meth)acrylate having a $C_4$–$C_{20}$ perfluoroalkyl group.

7. The repellant of claim 2, wherein the polyorganosiloxane chain of the second vinyl monomer has a molecular weight of 100–100,000.

8. The repellant of claim 2, wherein the copolymer comprises 100 parts by weight of the first vinyl monomer and 5–500 parts by weight of the second vinyl monomer.

9. The repellant of claim 2, wherein the repellant comprises 100 parts by weight of the water and oil repellant compound and 1–300 parts by weight of the copolymer.

10. The repellant of claim 1, wherein said blocking agent is selected from the group consisting of oxime, lactam and phenol compounds having a dissociation temperature in the range of from 50° to 180° C.

11. The repellant of claim 2, wherein said blocking agent is selected from the group consisting of oxime, lactam and phenol compounds having a dissociation temperature in the range of from 50° to 180° C.

* * * * *